US008074568B2

(12) United States Patent
Païta et al.

(10) Patent No.: US 8,074,568 B2
(45) Date of Patent: Dec. 13, 2011

(54) FOIL STAMPING MACHINE

(75) Inventors: Marco Païta, Oyonnax (FR); David Jean Robert Mandon, Oyonnax (FR); Laurent Callamand, Coisia (FR)

(73) Assignee: CER, Oyonnax (FR)

( * ) Notice: Subject to any disclaimer, the term of this patent is extended or adjusted under 35 U.S.C. 154(b) by 715 days.

(21) Appl. No.: 12/076,657

(22) Filed: Mar. 20, 2008

(65) Prior Publication Data

US 2009/0178581 A1 Jul. 16, 2009

Related U.S. Application Data

(60) Provisional application No. 60/907,409, filed on Apr. 2, 2007.

(30) Foreign Application Priority Data

Mar. 21, 2007 (FR) ..... 07 02056

(51) Int. Cl.
*B44B 5/00* (2006.01)
*B31F 1/07* (2006.01)

(52) U.S. Cl. ..... 101/27; 101/8; 101/9; 101/25; 101/3.1

(58) Field of Classification Search ..... 101/3.1, 101/8, 9, 21, 25, 27, 31
See application file for complete search history.

(56) References Cited

U.S. PATENT DOCUMENTS

| | | | | |
|---|---|---|---|---|
| 3,718,517 | A | 2/1973 | Berg | |
| 4,207,998 | A | 6/1980 | Schmid | |
| 5,611,272 | A * | 3/1997 | Steuer | 101/23 |
| 5,979,308 | A * | 11/1999 | Kagi et al. | 101/3.1 |
| 6,230,616 | B1 * | 5/2001 | Steuer | 101/23 |
| 7,424,903 | B2 * | 9/2008 | Kagi et al. | 156/459 |

FOREIGN PATENT DOCUMENTS

| | | | |
|---|---|---|---|
| CA | 2499715 | A1 | 1/2003 |
| DE | 666432 | C | 10/1938 |
| DE | 9420707 | U1 | 2/1995 |
| DE | 10009162 | A1 | 8/2001 |
| DE | 10163762 | A1 | 7/2003 |
| EP | 0623432 | A | 11/1994 |
| EP | 0858888 | A | 8/1998 |
| EP | 0989086 | A | 3/2000 |

* cited by examiner

*Primary Examiner* — Leslie J Evanisko
(74) *Attorney, Agent, or Firm* — Dowell & Dowell, PC

(57) ABSTRACT

A hot stamping machine including a stamping member which presses a stamping foil against a peripheral surface of articles which are successively positioned in a stamping position and wherein stamping foil is removed from an unwinding mechanism for each stamping sequence and passes in succession into a suction box, along a braking surface and opposite the stamping member that urges the foil against an article, and wherein a reserve of foil is available in the suction box between the unwinding means and the braking surface, while the foil is tensioned between the stamping member and the article, during stamping of the article, and between the braking surface and a rewinding mechanism.

8 Claims, 6 Drawing Sheets

FOIL STAMPING MACHINE

BACKGROUND OF THE INVENTION

1. Field of the Invention

The present invention relates to a hot stamping machine of the type comprising a stamping member, which is intended to press hot stamping foil against the peripheral surface of individual articles in order to stamp the articles.

2. Brief Description of the Related Art

In the field of stamping it is known to produce decorative patterns, for example metallic borders, on a plastic material article by means of a stamping machine, in which a stamping foil is pressed between a heated stamping member, which carries the patterns to be produced on the article, and the peripheral surface of the article. If the patterns to be produced are detailed, the width of the stamping foil used for stamping is selected to be as low as possible, in order to limit the stamping foil area which must be scrapped after each stamping and thus to reduce the costs associated with the stamping. However, the handling of a stamping foil of low width on a stamping machine is delicate.

In the case of stamping with a punch which is able to move in translation relative to the machine frame during stamping, or with a stamping wheel, the stamping member comes to press the stamping foil against the peripheral surface of the article to be stamped, which is driven in rotation. Conventionally the stamping foil is therefore moved opposite the stamping member, via unwinding from an unwinding reel which is fixed relative to the machine frame and rewinding onto a rewinding reel which is likewise fixed relative to the machine frame, an appropriate tension in the stamping foil being obtained between these two reels by means of a constant tension device, such as a spring-loaded beating arm. A suitable tension in the stamping foil is more important for a stamping foil of low width, which is particularly sensitive to vibrations or other disturbances which might alter its position relative to the stamping member. However, a constant tension device such as a beating arm generates, due to its inertia, and when the stamping foil is of a low width and the stamping rate is high, a jumping forwards motion of the stamping foil opposite the stamping element, along with a variation in the tension of the stamping foil. Such a variation in the tension of the stamping foil may lead to the appearance of stamping defects on the articles.

When stamping foil rewinding reel is moved with the punch which is able to move relative to the machine frame during stamping, or when the stamping is carried out with a stamping punch which is fixed relative to the frame during stamping, the stamping foil is conventionally fixed opposite the punch during stamping, the article which is to be marked being moved into contact with the punch in such a way as to squeeze the stamping foil between the punch and the peripheral surface of the article. The stamping foil thus undergoes strain when it is rewound, which may damage the stamping foil in the case of a low stamping foil width and a high stamping rate.

Besides, DE-U-94 20 707 discloses a hot embossing machine comprising an embossing cylinder and an underlying impression cylinder, between which an embossing gap is formed. The embossing cylinder is provided along its circumference with a heatable embossing die, which is intended to press a stamping foil against a material layer. In this machine, the speed of the stamping foil in the embossing gap is controlled by a suction rotative control roller, which is arranged upstream from the embossing gap. More precisely, the stamping foil cooperates without sliding with the upstream rotative control roller, whose rotation is controlled by a driving motor, the stamping foil being drawn at a constant speed by a pull device arranged downstream from the embossing gap. Depending on its rotation speed, the upstream rotative roller is thus able to decrease or increase the speed of the stamping foil in the embossing gap relative to the speed which results from the pulling of the downstream pull device. Such a control of the speed of the stamping foil performed by an upstream rotative control roller driven by a motor is satisfactory when the stamping foil continuously moves in the embossing gap, the speed of the stamping foil being simply decreased or increased. However, when the stamping foil is to be moved only sequentially, as it is the case for the stamping of individual articles, the use of a rotative control roller driven by a motor and arranged upstream from the embossing gap is not adapted. In this case, the stamping foil should be rapidly accelerated from a zero speed. In practice, the driving of the stamping foil, notably for a stamping foil of low width, by a rotative roller driven by a motor and arranged upstream from the embossing gap would lead either to the appearance of stamping defects on the articles, due to a too high stamping foil speed causing the stamping foil to accumulate at the stamping member during the stamping, or to the breaking of the stamping foil, due to a too low stamping foil speed causing stamping foil tension peaks. Indeed, in practice, it would be delicate and even impossible to get a perfect synchronisation of the rotation speed of the control roller relative to the movement of the articles being brought successively opposite the stamping member.

SUMMARY OF THE INVENTION

It is these difficulties that the invention is most particularly intended to overcome, by proposing a stamping machine with a fixed or moving stamping punch, allowing a high reliability and quality of stamping to be obtained, even with low stamping foil widths and at high stamping rates.

For this purpose, the invention relates to a hot stamping machine of the type comprising a stamping member, which is intended to press a stamping foil against the peripheral surface of individual articles in order to stamp said articles, the individual articles being positioned successively into a stamping position and stamped by a stamping sequence which is repeated for each article, the machine comprising stamping foil unwinding means, intended to sequentially unwind a length of stamping foil at the end of each stamping sequence for the next stamping sequence, and stamping foil rewinding means, the stamping machine further comprising a stamping foil suction box and a stamping foil braking surface, the braking surface having a fixed orientation relative to the frame of the machine during each stamping sequence, the stamping foil which comes from the unwinding means passing in succession into the suction box, along the braking surface and opposite the stamping member, in such a way that a reserve of stamping foil is available in the suction box between the unwinding means and the braking surface, while the stamping foil is tensioned opposite the stamping member between the braking surface and the rewinding means.

According to further advantageous characteristics of the invention, taken in isolation or in any technically feasible combinations:

- the braking surface is a surface pierced through with suction holes for the suction of the stamping foil;
- the braking surface is formed by a braking cylinder, around which the stamping foil is partially wound;
- the braking cylinder comprises an external casing, which forms the braking surface, and a hollow internal body, housed in the casing and connected to a negative pressure source, the casing being pierced through with stamping foil suction holes in the braking surface which are able to communicate with the interior of the hollow body via corresponding holes in said body, the holes in the body being able to be angularly offset relative to the holes of the casing in such a way as to modify the suction force exerted on the stamping foil by the braking surface;

the unwinding means are motorised, the machine comprising detection means for detecting the length of the stamping foil which is available between the unwinding means and the braking surface, these detection means being connected to the motorisation system of the unwinding means in such a way as to modify the aforementioned length of the stamping foil;

the suction box comprises means for confining the stamping foil against internal walls of the suction box;

the stamping member is fixed in translation relative to the machine frame during the stamping of an article, the machine comprising means for moving the article relative to the stamping member, which means move said article at least in rotation about an axis during stamping;

the stamping member is able to move in translation relative to the machine frame and parallel to an axis during the stamping of an article, the machine comprising means for moving the article relative to the stamping member, which means move said article solely in rotation about an axis during stamping;

the braking surface performs a movement in translation relative to the machine frame which is identical to that of the stamping member during the stamping of an article;

the rewinding means perform a movement in translation relative to the machine frame which is identical to that of the stamping member during the stamping of an article;

the stamping member is a flat punch or a stamping wheel.

BRIEF DESCRIPTION OF THE DRAWINGS

The features and advantages of the invention will become apparent from the following description of two embodiments of a stamping machine according to the invention, given merely by way of example and with reference to the accompanying drawings, in which.

DESCRIPTION OF THE PREFERRED EMBODIMENT

Figure 1:
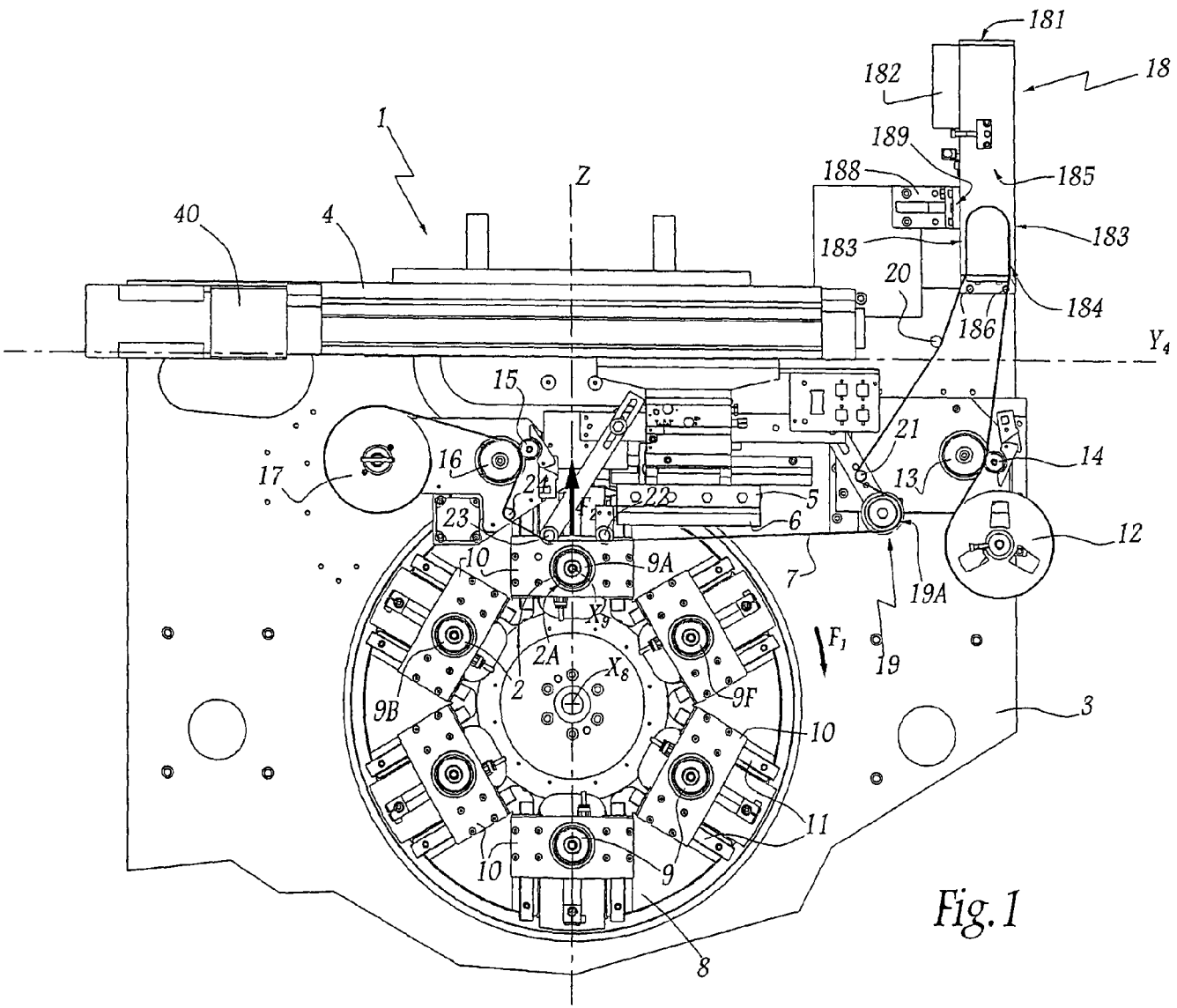
FIG. 1 is a front view of a stamping machine, in accordance with a first embodiment of the invention, between two marking sequences.

The stamping machine 1, shown in FIG. 1 to 4, is intended to stamp articles 2 which are cylindrical at least in part and are made of plastics material. By way of non-limiting example, the articles 2 may be packaging for cosmetic products. The machine 1 comprises a main frame 3, which holds a substantially horizontal upper rail 4. A heating stamping head 5 is mounted so as to slide relative to the rail 4. The stamping head 5 can move in translation relative to the frame 3, parallel to a longitudinal axis $Y_4$ of the rail 4, by the action of driving means (not shown) which are connected to a motor 40. The stamping head 5 is equipped with a flat punch 6, made of metal or of silicone, which defines the patterns which are to be stamped onto the articles 2. The stamping of each article 2 is carried out by heating and compressing a metal-coated stamping foil 7 between the punch 6 and the external peripheral surface 2A of the article 2.

The machine 1 comprises a turntable 8 which turns in the direction of the arrow $F_1$ in FIG. 1, about an axis $X_8$ which is substantially horizontal and perpendicular to the axis $Y_4$. In a variant, the turntable 8 may turn in the opposite direction from that shown in FIG. 1. The turntable 8 is as disclosed in the document EP-A-1 518 675. The turntable 8 is provided with six cylindrical cores 9 with circular cross-sections, which are intended each to receive an article 2. Each core 9 is mounted on a support 10, so as to rotate about an axis $X_9$ substantially parallel to the axis $X_8$.

Because of the rotation of the turntable 8, the cores 9 may occupy six distinct positions in succession. The uppermost position, which is occupied by the core denoted 9A in FIG. 1 to 4, corresponds to a stamping position, for stamping the article 2 which is mounted on said core 9A. The position which is located to the left of the stamping position and is occupied by the core denoted 9B in FIG. 1 to 4 may correspond to a tracking position, for tracking one or more particular points on the article 2 mounted on the core 9B, for example by means of a tracking camera (not shown). The position which is located to the right of the stamping position and is occupied by the core denoted 9F in FIG. 1 to 4 may correspond to a stamp inspection position, for inspecting the stamp on the peripheral surface 2A of the article 2 carried on the core 9F, for example by means of an inspection camera (also not shown), the stamping having been carried out while the core 9F was in the stamping position. Finally, the other positions may correspond to positions for loading and unloading articles 2 on and off the cores 9.

The support 10 of each core 9 is supported on rails 11. When a core 9 arrives in the region of the stamping position, which is occupied by core 9A in FIG. 1 to 4, the support 10 of this core is able to slide vertically, along the rails 11, relative to the turntable 8 and the frame 3, as indicated by arrow $F_2$ in FIG. 1. Thus when in the stamping position each core 9 is capable of moving the article 2, which it is carrying, relative to the frame 3, simultaneously in rotation about the axis $X_9$, and in translation parallel to a vertical axis Z. When a core 9 is in one of the other five positions, sliding of the support 10 relative to the rails 11 is not allowed, and the support 10 is immobilised in the region of the centre of the turntable 8.

FIG. 1 shows the arrangement of the elements which constitute the machine 1 before the stamping of the article 2 which is carried into the stamping position by the core 9A. The stamping foil 7 then extends opposite the punch 6, between a stamping foil unwinding reel 12 and a stamping foil rewinding reel 17. In the following, the terms "upstream" and "downstream" will refer to the direction of travel of the stamping foil 7 on the machine 1, from reel 12 to reel 17.

The unwinding reel 12 is connected to a motorised driving cylinder 13, located downstream from the reel 12 and suitable for actuating, by rotating, the unwinding of the stamping foil 7 from the reel 12, the stamping foil 7 being pressed against the driving cylinder 13 by a pressure roller 14. Similarly, the rewinding reel 17 is connected to a motorised driving cylinder 16, located upstream from the reel 17 and against which the stamping foil 7 is pressed by at least one pressure roller 15, in such a way that the rotation of the driving cylinder 16 actuates the rewinding of the stamping foil 7 about the reel 17. Advantageously, the motors with which the driving cylinders 13 and 16 are provided are motors of the brushless type, suitable for being controlled selectively by a control unit (not shown) of the machine 1, depending on the desired unwinding and rewinding of the stamping foil 7.

The machine 1 comprises a suction box 18, located vertically above the unwinding means 12-14. The suction box 18 is provided to suck the stamping foil 7 in at the output of the unwinding means 12-14, in such a way that the stamping foil 7 forms a bend on the inside of the box 18. The machine 1 further comprises a braking cylinder 19, which defines a braking surface 19A and is located in the region of the punch 6, and around which the stamping foil 7 is partially wound at the output of the suction box 18. The braking surface 19A defined by the braking cylinder 19 is fixed in rotation relative to the frame 3 of the machine 1 during each stamping sequence. The machine 1 also comprises five cylindrical strippers 20-24, the stamping foil 7 passing around strippers 20 and 21 between the suction box 18 and the braking cylinder 19, and around strippers 22, 23 and 24 between the braking cylinder 19 and the unwinding means 15-17. In this embodiment, the braking cylinder 19, the strippers 23 and 24 and the rewinding means 15-17 are moved with the stamping head 5, i.e. are moved in translation, parallel to the longitudinal axis $Y_4$ of the rail 4, at the same time as the stamping head 5, by the action of the driving means which are connected to the motor 40.

The suction box 18 is substantially in the shape of a parallelepiped and is delimited by a base wall 181, from which there extend two opposing lateral walls 183 and two opposing front and back walls 185. A fan 182 is provided to create a negative pressure within the box 18 so as to produce a suction effect, towards the inside of the box 18, on the stamping foil 7. The stamping foil 7 enters the box 18 through a lower hole 184 of said box 18, facing the base wall 181. Two strippers 186 which are arranged in the region of the hole 184 are intended to confine the stamping foil 7, which is drawn inside the box under suction, against the two opposing walls 183. Between the unwinding means 12-14 and the braking surface 19A, the stamping foil 7 is tensioned slightly, just enough to counteract its own weight between the elements 12-14 on the one hand, and the braking surface 19A on the other. In the following, the tension of the stamping foil 7 between the elements 12-14 and the surface 19A is designated as the inherent tension of the stamping foil 7.

It is advantageous for the suction box 18 further to comprise an internal wall, not shown in the figures, which is parallel to the front and back walls 185 and can move within the box 18, parallel to said walls 185, by sliding. The depth of the suction box 18 which is available for the stamping foil 7 may thus be modified as a function of the width of the stamping foil 7 used, so as to ensure the confinement thereof between the side walls 183, the front wall 185 and the internal wall of the suction box 18. The positioning of the stamping foil 7 within the suction box 18 is thus fixed exactly, this being particularly advantageous with a stamping foil 7 which is of low width and which is easily displaced under the effect of vibrations or other disturbances to the machine 1.

In this embodiment, those wall portions of the suction box 18 which are intended to be in contact with the stamping foil 7 are made of aluminium. In a variant, these wall portions may be made of any other material which is not likely to be electrically charged by friction against the stamping foil 7. By way of example, the box 18 may be made of a transparent material, such as polycarbonate or Plexiglas, covered on the inside with Teflon or aluminium on the walls which contact the stamping foil 7. Satisfactory travel of the stamping foil 7 inside the suction box 18 is thus ensured due to the suction effect of the fan 182, without the risk of disturbances connected with the occurrence of electrostatic charges on the interface between the walls of the box 18 and the stamping foil 7.

The suction box 18 is further equipped with a detection cell 188, which is intended to detect the presence of the stamping foil 7 within its field of vision. As shown in FIG. 1 to 4, the cell 188 is disposed in the region of a side opening 189 of the chamber 18, a glazed wall of the cell 188 sealing said opening 189. The signal which comes from the cell 188 is advantageously transmitted to the brushless motor which is connected to the driving cylinder 13, in such a way that the unwinding of the stamping foil 7 is stopped when the cell 188 detects the presence of the stamping foil 7. The dimensions of the box 18 and the positioning of the cell 188 are set so as to ensure a sufficient reserve of stamping foil 7 within the box 18 for each stamping sequence.

In a variant, the detection cell 188 may be replaced with a distance measurement cell, located in the region of the base wall 181 of the box 18. A cell of this type is thus also connected to the brushless motor which is connected to the driving cylinder 13, in such a way that a sufficient reserve of stamping foil 7 is available inside the box 18 for each stamping sequence. The cell 188 may also be connected to a second cell which detects a minimal length of stamping foil 7 inside the box 18, connected to the brushless motor that powers the driving cylinder 13, in such a way that unwinding of the stamping foil 7 is actuated when this second cell does not detect the presence of the stamping foil 7. A minimum length of stamping foil 7 may thus be maintained inside the suction box 18. According to another variant, the brushless motor that powers the drive cylinder 13 for unwinding the stamping foil 7 may be replaced with an asynchronous motor, which is connected to a control unit suitable for processing the information from the detection cell 188 and for regulating the speed of rotation at the output of the asynchronous motor as a function of this information. In another variant, the motorisation system of the unwinding means may also be connected directly to the unwinding reel 12, the speed of rotation at the output of the motor being altered depending on the information from the detection cell and the unwinding state of the stamping foil 7 relative to the reel 12. In this last variant, the presence of the driving cylinder 13 and the pressure cylinder 14 is no longer necessary.

Figure 5:
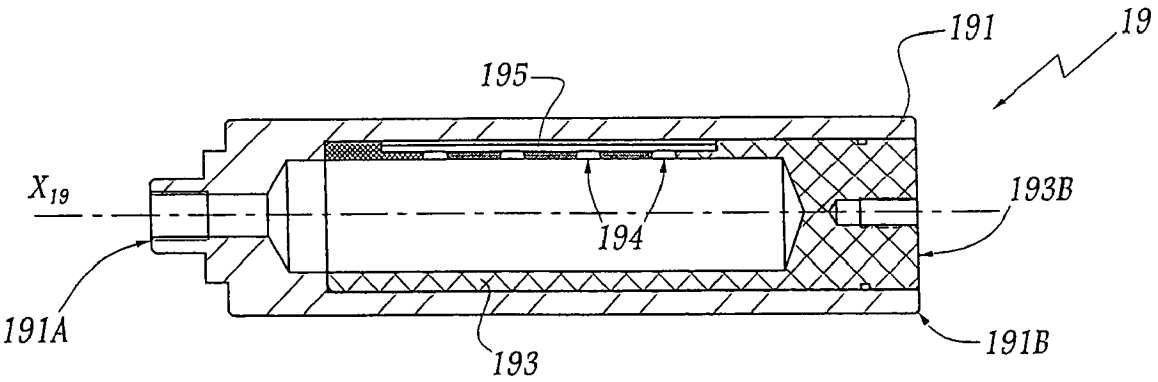
FIG. 5 is a section on a larger scale of a braking cylinder of the stamping machine shown in FIG. 1 to 4.
Figure 6:
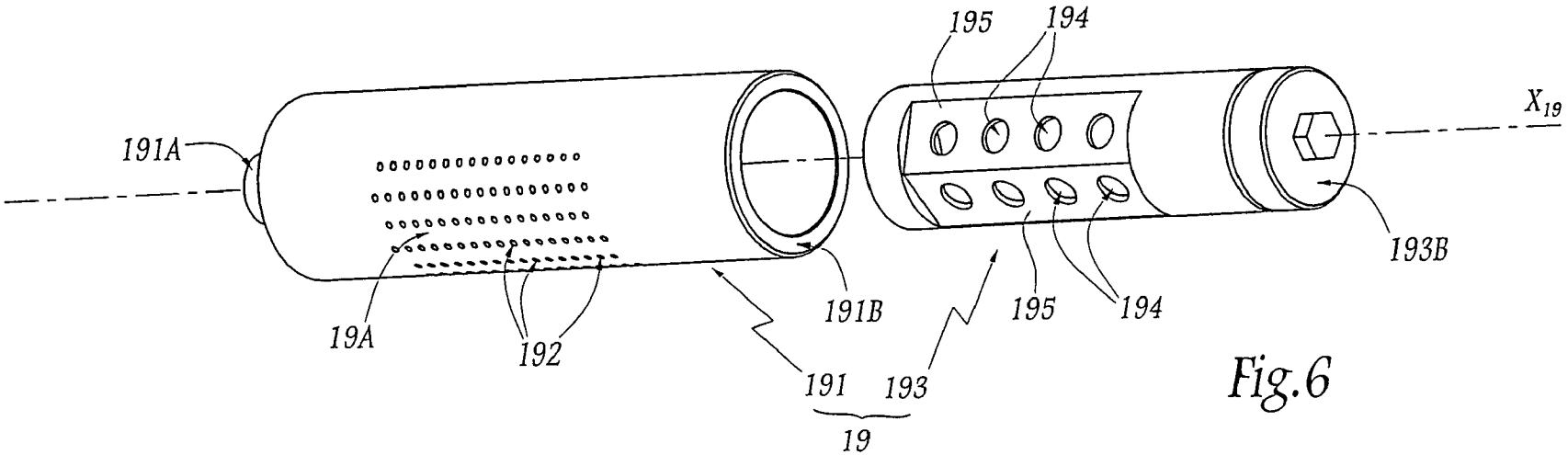
FIG. 6 is an exploded perspective view of the braking cylinder of FIG. 5.

The braking cylinder 19, which can be seen at a larger scale in FIGS. 5 and 6, comprises a tubular casing 191, which is centred on an axis $X_{19}$ and in which there is housed a hollow body 193, of a shape substantially complementary to that of the casing 191. A first end 191A of the casing 191 is provided with an end-piece for connection to a negative pressure source such as, by way of non-limiting examples, a venturi tube, a vacuum source or a fan, said end-piece opening into the interior space of the hollow body 193. The second end 191B of the casing 191, opposite end 191A, is sealed by a corresponding end portion 193B of the body 193 fixed in the casing 191. Thus, a negative pressure may be created inside the body 193. As is shown more particularly in FIG. 6, the casing 191 is provided with through-holes 192 on a portion 19A of the external peripheral surface thereof, which forms the braking surface of the cylinder 19, corresponding through-holes 194 likewise being provided in the body 193. The holes 194 are provided in two flat portions 195 of the body 193, which extend over an angular sector having a vertex angle which is substantially equal to that defined by the braking surface 19A. When the holes 194 are located in line with the holes 192, the latter communicate with the interior of the body 193. Thus when a negative pressure is created inside the body 193, the stamping foil 7, which is partially wrapped around the casing 191 of the cylinder 19, is held against the surface 19A because of the suction generated through the holes 192.

In order to alter the suction force exerted on the stamping foil 7 by the braking surface 19A, the body 193 is able to turn within the casing 191, about the axis $X_{19}$. It is thus possible angularly to offset the holes 194 of the body 193, relative to the holes 192 for the suction of the stamping foil 7, so as to vary the flow of air through the holes 192. Further, it is possible to turn the casing 191 about the axis $X_{19}$ relative to the frame 3 of the machine 1, so as to change the orientation of the braking surface 19A relative to said frame, for example when adjusting the parameters of the machine 1 between two stamping sequences. The interaction between the braking surface 19A and the stamping foil 7 may thus be altered depending on the parameters of the stamping process, and in particular depending on the profile of the articles which are to be stamped.

Because of the braking resulting from the suction on the stamping foil 7 at the surface 19A of the cylinder 19, the stamping foil 7 may be adjustably tensioned without any undesirable inertial effects, between the surface 19A and the rewinding means 15-17, irrespective of the unwinding state of the stamping foil 7 upstream from the surface 19A. The combination of the suction box 18, located at the output of the motorised unwinding means 12-14, and the braking surface 19A thus allows the provision of a reserve of stamping foil 7 with a low tension upstream from the braking surface 19A, while a suitable tension is maintained in the stamping foil 7 for stamping downstream from the braking surface 19A.

Figure 2:
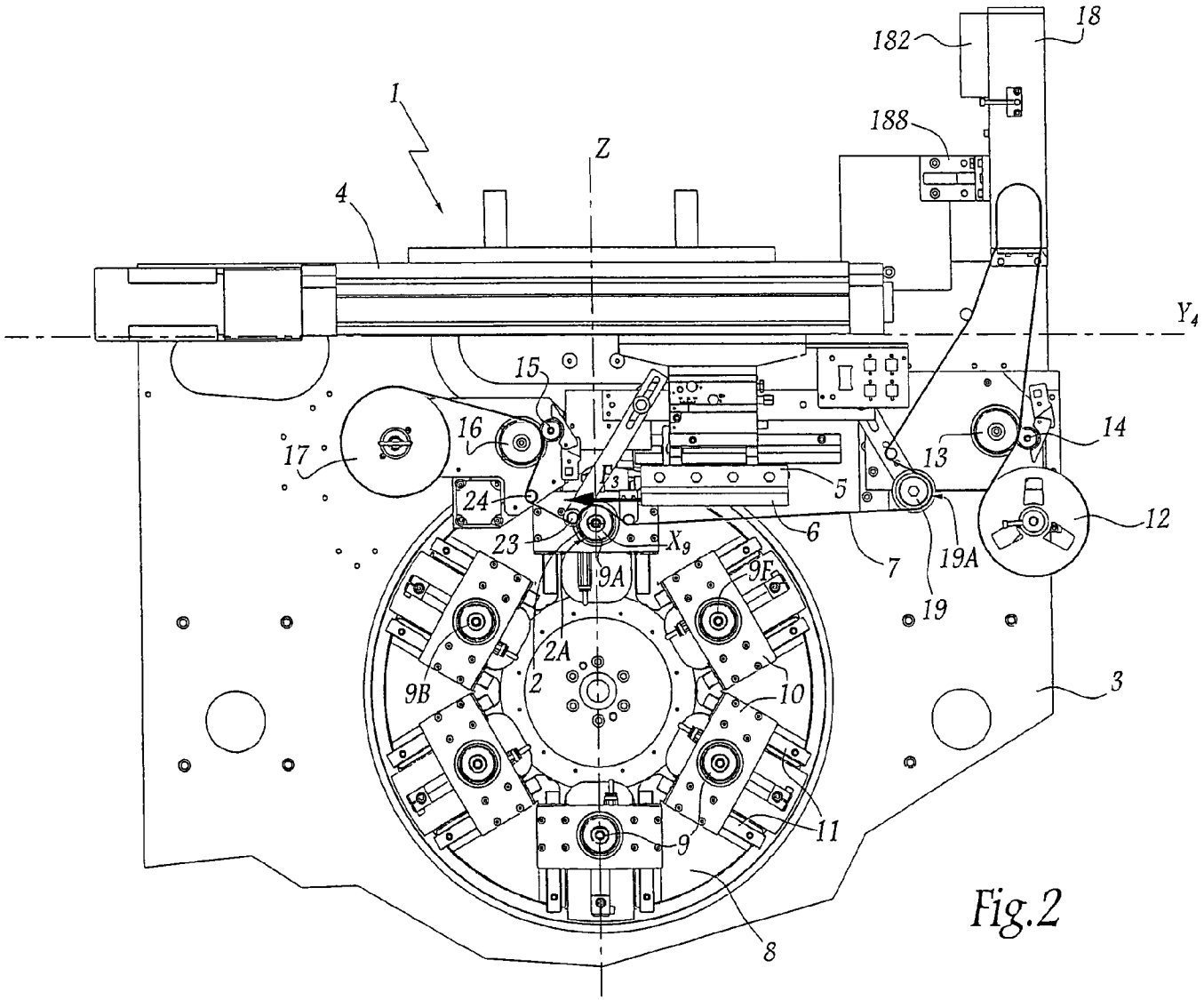
FIG. 2 is a view equivalent to that of FIG. 1 during a first step of a marking sequence.

A stamping sequence for an article 2 on the machine 1, illustrated for the article 2 carried by the core 9A in FIG. 1 to 4, comprises steps in which:

Initially, the support 10 of the core 9A slides along rails 11, in the direction of the arrow $F_2$ of FIG. 1, so as to reach the position which can be seen in FIG. 2. In this position the punch 6 is located to the right of the article 2 which is carried by the core 9A, the relative height of the article 2 and the punch 9 being set in such a way that the punch 6 is able to come into contact with the external peripheral surface 2A of said article 2 which is to be stamped, via a translational movement in the direction of the article 2, parallel to the axis $Y_4$.

Figure 3:
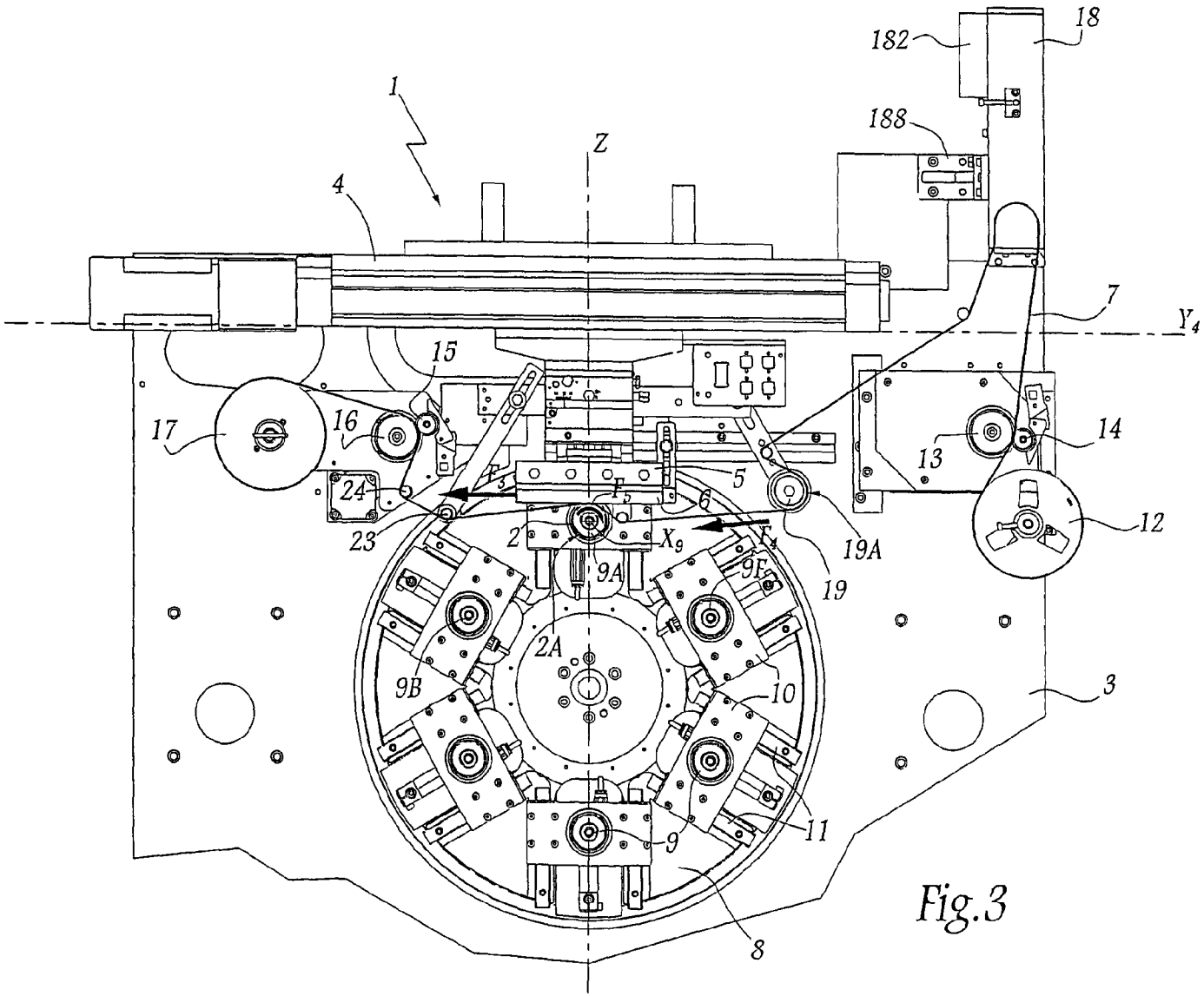
FIG. 3 is a view equivalent to that of FIG. 1 during a second step of a marking sequence.

When the core 9A has positioned the article 2 in this position, the punch 6 which is carried by the stamping head 5 is moved in translation relative to the frame 3, parallel to the longitudinal axis $Y_4$ of the rail 4 and in the direction of the article 2 which is to be stamped, as shown by arrow $F_3$ in FIGS. 2 and 3. The braking cylinder 19, the strippers 23 and 24 and the rewinding means 15-17, which are fixed in translation with the stamping head 5, are thus also moved parallel to the axis $Y_4$. The stamping foil 7 is thus unwound out of the suction box 18 and travels relative to the frame 3 in the direction of the arrow $F_4$ of FIG. 3, at a speed equal to the speed of translation of the punch 6 relative to the frame 3.

Simultaneously with the translational movement of the punch 6 in the direction of the arrow $F_3$ and the travel of the stamping foil 7 in the direction of the arrow $F_4$, the article 2 is driven in rotation about the axis $X_9$ of the core 9A, in the direction of the arrow $F_5$ in FIG. 3. When the punch 6 comes into contact with the article 2, the stamping foil 7 is pressed, while being heated, against the external peripheral surface 2A of the article 2 which is being driven in rotation, thus allowing the article 2 to be stamped.

In order to promote the cooling of the stamping foil 7 after it has left the article 2 during the stamping process, it is advantageous for a slack in the stamping foil to be provided, at the beginning of the stamping, via a backwards rotation of the brushless motor which is connected to the rewinding means 15-17.

Figure 4:
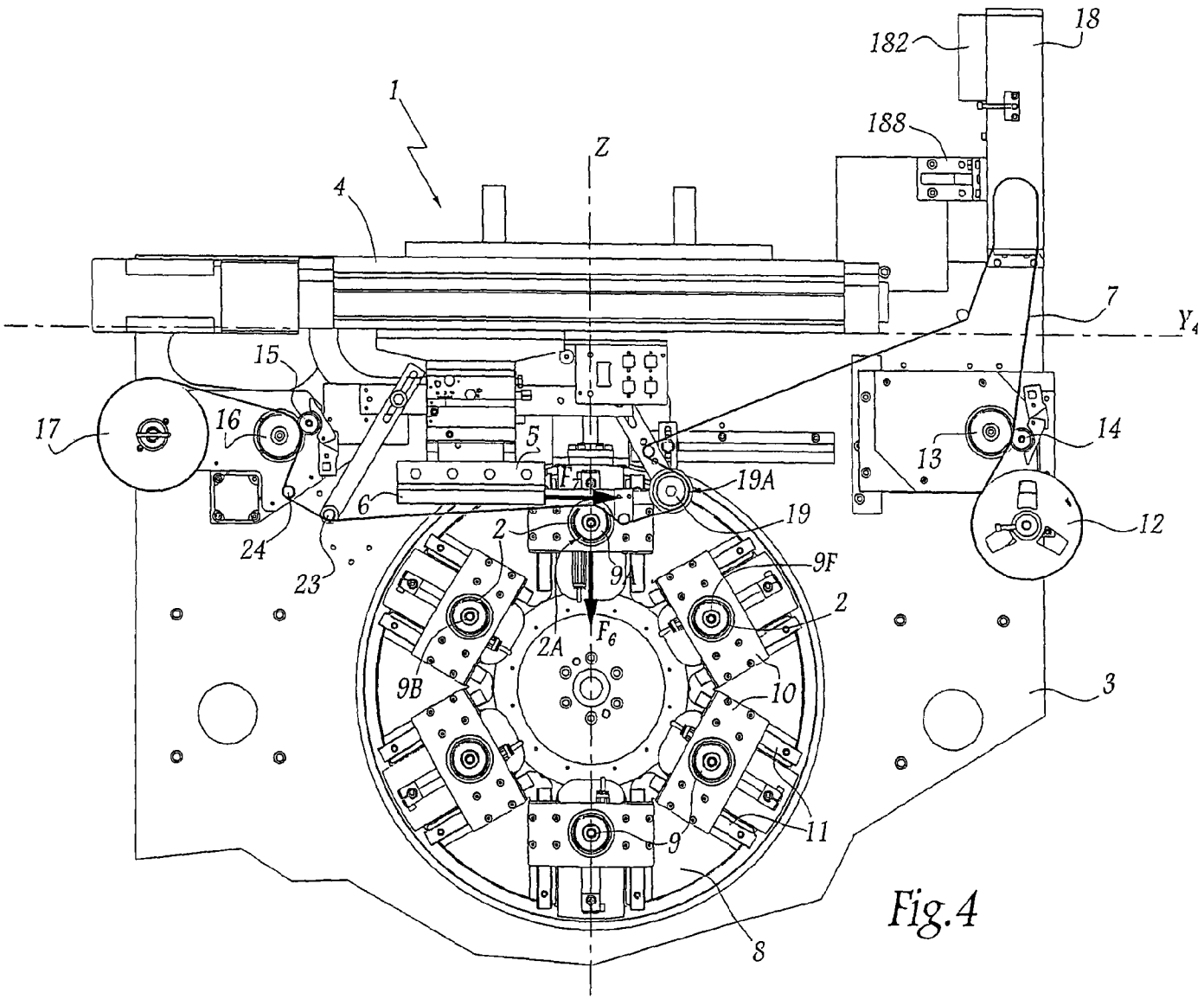
FIG. 4 is a view equivalent to that of FIG. 1 during a third step of a marking sequence.

At the end of the stamping process, the punch 6 is located to the left of the article 2, as can be seen in FIG. 4. The core 9A, which turns on itself about the axis $X_9$, is thus moved vertically towards the centre of the turntable 8, by means of the support 10 thereof being slid along the rails 11 in the direction of the arrow $F_6$ in FIG. 4. During the vertical movement of the core 9A, the turntable 8 is pivoted in the direction of the arrow $F_1$ in FIG. 1, the synchronisation of the movements of the core 9A and the turntable 8 being achieved by means of a control unit (not shown).

The stamping head 5 provided with the punch 6, and the braking cylinder 19, the rewinding means 15-17 and the strippers 23 and 24 are also moved towards the initial position thereof, via a translational movement parallel to the axis $Y_4$ in the direction of the arrow $F_7$ in FIG. 4. At the same time, the worn stamping foil 7 is rewound around the rewinding reel 17, while a length of stamping foil is unwound from the reel 12 and placed in reserve for another stamping sequence by the action of the motor which is connected to the driving cylinder 13. The configuration of the machine 1 as shown in FIG. 1 is thus encountered, a portion of new stamping foil being available again between the unwinding means 12-14 and the rewinding means 15-17, in preparation for a further stamping.

The heated stamping foil 7 tends to adhere to the surface 2A of the article 2 carried on the core 9A. During the movement of the article 2 at the end of the stamping, which results from the combined movements of the core 9A and the turntable 8, the stamping foil 7 thus receives a slight pull in the direction of movement of the article. This pull on the stamping foil 7 at the end of the stamping produces a disruptive slack in the stamping foil 7 between the braking surface 19A and the rewinding means 15-17. This disruptive slack in the stamping foil 7 is taken up during the rewinding of the stamping foil 7 subsequent to the stamping. Further, this disruptive slack in the stamping foil 7 may likewise be taken up by momentarily deactivating the suction of the braking surface 19A in such a way that the disruptive slack is ravelled up in the suction box 18.

At the end of the stamping sequence, the turntable 8 has, via the rotation thereof in the direction of the arrow $F_1$ of FIG. 1, positioned the core 9B in the stamping position. The stamping of the article 2 carried by the core 9B is achieved by repetition of the steps disclosed previously for the stamping of the article 2 carried by the core 9A.

Upon completion of the steps disclosed above for a stamping sequence for an article 2, the guidance of the stamping foil 7 on the machine 1 according to this first embodiment of the invention allows the stamping of each article 2 to be performed with a high reliability and a high quality of stamping, even for a low width of the stamping foil 7, in particular between 8 mm and 25 mm, and a high stamping rate, for example greater than 3000 articles per hour, in particular greater than 6000 articles per hour, produced by a single stamping head. Indeed, the combination of the suction box 18, located at the output of the motorised unwinding means 12-14, and the braking surface 19A allows a sufficient tension of the stamping foil 7, suitable for the function thereof, to be ensured opposite the punch 6. The tension of the stamping foil 7 is suitable for stamping if it allows upward guidance and lateral guidance of the stamping foil. Thus, the risk of deflection of the stamping foil or formation of waves in the stamping foil, which would detract from the quality of the stamping, is avoided. Waves of this type in the stamping foil are especially likely to occur when stamping articles having a conical form. Further, the risk of a jumping motion of the stamping foil 7 with variation in the tension thereof, due to the inertia of the unwinding means 12-14, is eliminated because of the reserve of stamping foil 7 with a low tension which is formed inside the suction box 18 and during the braking of the stamping foil 7 by the braking surface 19A, with the suction box 18 and the braking surface 19A introducing no undesirable inertial effects. The motion of the stamping foil 7 thus proceeds with a substantially constant tension of the stamping foil, guaranteeing high-quality stamping of the articles 2.

Figure 7:
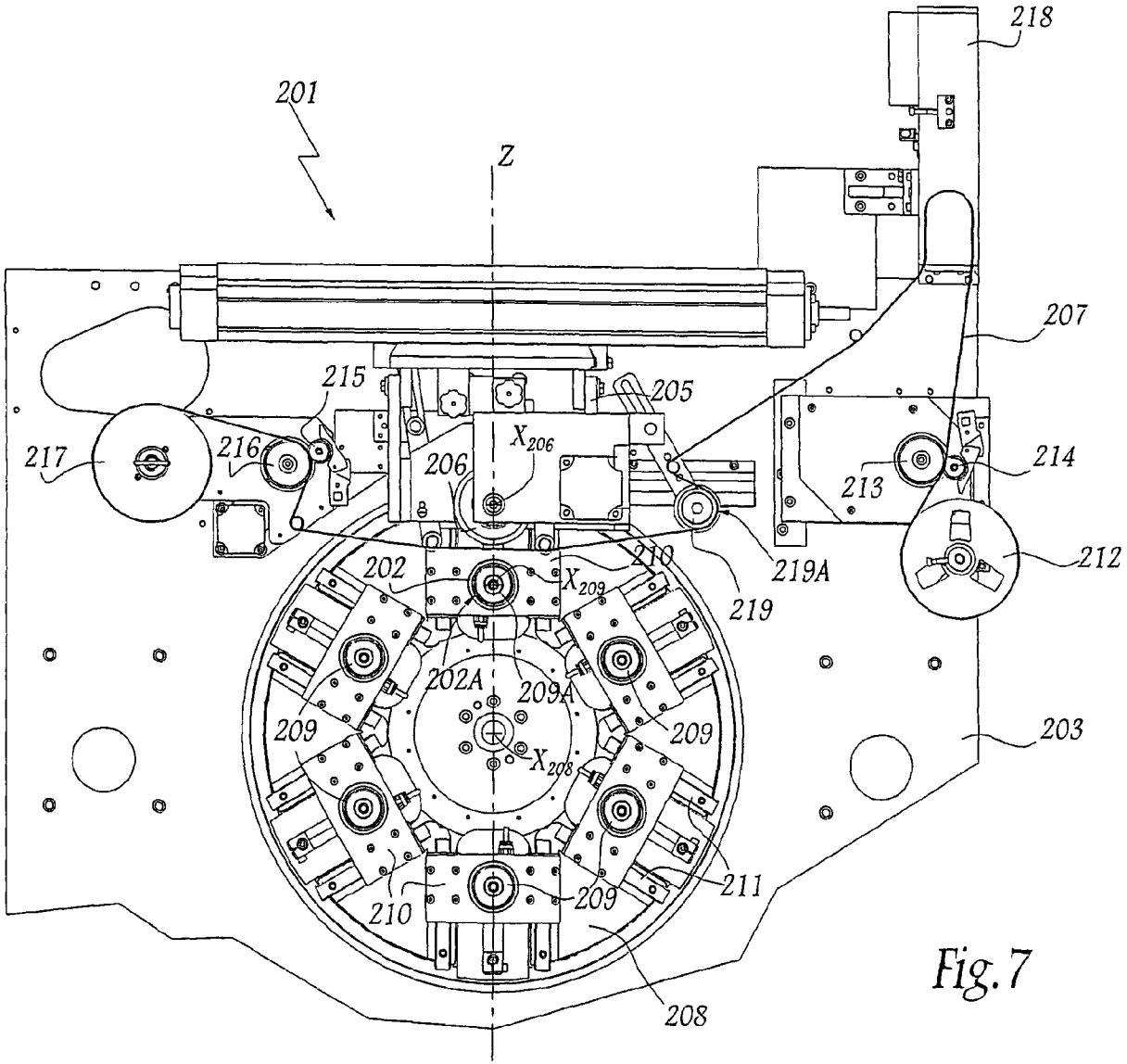
FIG. 7 is a view equivalent to that of FIG. 1 of a stamping machine in accordance with a second embodiment of the invention.

In the second embodiment, which is shown in FIG. 7, the equivalent elements to those in the first embodiment have the same reference numbers but increased by 200. The stamping machine 201 according to this second embodiment comprises a heating stamping head 205, fixed relative to a frame 203 of the machine 201. A silicone stamping wheel 206 is mounted so as to revolve on the stamping head 205, about an axis $X_{206}$ which is substantially horizontal and perpendicular to the plane of FIG. 7. The wheel 206 carries embossments which are to be stamped on the at least partially cylindrical articles 202, the stamping of each article 202 being carried out via the heating and compression of a metallic-coated stamping foil 207 between the wheel 206 and the external peripheral surface 202A of the article 202.

The machine 201 comprises a turntable 208, equivalent to the turntable 8 of the first embodiment and intended to turn, between two stamping sequences, about an axis $X_{208}$ which is substantially parallel to the axis $X_{206}$. As in the first embodiment, the turntable 208 is provided with six cylindrical cores 209 with circular cross-sections, which are intended each to receive an article 202. Each core 209 is mounted on a support 210, rotatably about an axis $X_{209}$ which is substantially parallel to the axes $X_{206}$ and $X_{208}$, each support 210 being supported by rails 211. The sliding of a core 209 along the rails 211 is allowed only when said core 209 is in the region of a stamping position, which is occupied by core 209A in FIG. 7. When in the region of this stamping position, a core 209 is capable of moving the article 202, which it is carrying, relative to the frame 203, simultaneously in rotation about the axis $X_{209}$ and in translation parallel to a vertical axis Z.

FIG. 7 shows the arrangement of the elements which constitute the machine 201 before the stamping of the article 202, which is carried into the stamping position by the core 209A. The wheel 206 is disposed vertically above said article 202, the stamping foil 207 extending between the wheel 206 and the article 202, from the motorised unwinding means of the stamping foil 207, which comprise an unwinding reel 212, a driving cylinder 213 and a pressure roller 214, to the motorised rewinding means of the stamping foil 207, which comprise a rewinding reel 217, a driving cylinder 216 and a pressure roller 215, similarly to in the first embodiment. The machine 201 also comprises a suction box 218, disposed vertically above the unwinding means 212-214, as well as a braking cylinder 219, which defines a braking surface 219A and is located in the region of the wheel 206, and around which the stamping foil 207 is partially wound at the output of the suction box 218. As in the first embodiment, the braking surface 219A defined by the braking cylinder 219 is fixed in rotation relative to the frame 203 of the machine 201 during each stamping sequence. The course of the stamping foil 207 is also guided by strippers (not labelled), the control means 212-219 of the stamping foil 207 being fixed, as a whole, relative to the frame 203 of the machine 201. As in the first embodiment, the combination of the suction box 218, located at the output of the motorised unwinding means 212-214, and the braking surface 219A is intended to provide a reserve of stamping foil 207 with no tension other than the inherent tension thereof, upstream from the braking surface 219A, while a suitable tension is maintained in the stamping foil 207 for stamping downstream from the braking surface 209A. As in the first embodiment, the suction box 218 and the braking surface 219A introduce no undesirable inertial effects.

A stamping sequence for an article 202 on the machine 201, according to this second embodiment, comprises steps in which:

Initially, the wheel 206, which is driven in a rotational movement about the axis $X_{206}$ thereof in between two stamping sequences in order to be heated, is accelerated to the stamping speed. The article 202 carried by the core 209A, which is in the stamping position, is driven in rotation by the core 209A about the axis $X_{209}$, at the stamping speed and with a direction of rotation which is the opposite of that of the wheel 206. In parallel, the support 210 of the core 209A slides vertically upwards along the rails 211, in the direction of the wheel 206.

When the article 202 carried on the core 209A comes into contact with the wheel 206, the motor which is connected to the driving cylinder 216 is actuated in such a way as to draw in the stamping foil 207 and cause said stamping foil to move relative to the frame 203, at a suitable speed for stamping. The movement of the stamping foil 207 results from the unwinding of the stamping foil out of the suction box 218 and the rewinding of the stamping foil by the rewinding means 215-217. In accordance with the invention, a reserve of stamping foil with no tension other than the inherent tension thereof is maintained in the suction box 218 for each stamping process, similarly to in the first embodiment. The stamping foil 207 arranged between the wheel 206 and the article 202 is pressed, while being heated, between the peripheral surface of the wheel 206 and the peripheral surface 202A of the article 202 which are being driven in rotation, whereby the stamping of the article 202 is achieved.

In order to promote the cooling of the stamping foil 207 after it has left the article 202 during the stamping process, it is advantageous for a slack in the stamping foil to be provided, at the beginning of the stamping, by producing a slowing of the drawing of the stamping foil 207 or a temporary halt in the drawing of the stamping foil 207 via the rewinding means 215-217, by means of appropriate control by the motor which is connected to said means 215-217.

At the end of the stamping process, the core 209A, which turns on itself about the axis $X_{209}$, is moved vertically towards the centre of the turntable 208 by means of the support 210 thereof being slid along the rails 211, distancing the article 202 from the wheel 206. During the vertical movement of the core 209A, the turntable 208 is also pivoted, the synchronisation of the movements of the core 209A and the turntable 208 being achieved by means of a control unit (not shown).

As in the first embodiment, the heated stamping foil 207 tends to adhere to the surface 202A of the article 202. During the movement of the article 202 at the end of the stamping, which results from the combined movements of the core 209A and the turntable 208, the stamping foil 207 thus receives a slight pull in the direction of movement of the article. This pull on the stamping foil 207 at the end of the stamping produces a disruptive slack in the stamping foil 207 between the braking surface 219A and the rewinding means 215-217. This disruptive slack in the stamping foil 207 is taken up by momentarily deactivating the suction of the braking surface 219A in such a way that the disruptive slack is ravelled up in the suction box 218.

At the end of the stamping sequence, the turntable 208 has, via the rotation thereof, positioned another core 209 in the stamping position.

Irrespective of the embodiment, a stamping machine according to the invention therefore allows stamping of articles to be achieved with a high reliability and a high quality of stamping, even with a low width of stamping foil being used and with a high stamping rate, because of the combination of the suction box, located at the output of the motorised unwinding means, and the braking surface. Indeed, the reserve of stamping foil at a low tension, which is formed in the interior of the suction box, provides freedom from the inherent inertia of the unwinding means, and allows a movement of the stamping foil opposite the stamping member with a substantially constant tension to be obtained, whilst the braking surface is necessary to ensure a suitable tension of the portion of stamping foil passing opposite the stamping member. This tension in the stamping foil is achieved without any undesirable inertial effects, unlike the tension which would be achieved with a constant tension device such as a spring-loaded beating arm.

In other words, in a stamping machine according to the invention, comprising a suction box, disposed at the output of motorised unwinding means, and a braking surface, the reserve of stamping foil in the suction box has a relatively low tension, whilst the stamping foil has a second tension, higher than the first tension, between the braking surface and the rewinding means, this second tension being suitable for the stamping of articles. Further, the suction box and the braking surface introduce no undesirable inertial effects.

The invention is not limited to the examples which are disclosed and illustrated. In particular, a hot stamping machine according to the invention, comprising a suction box, disposed at the output of motorised unwinding means, and a braking surface, may be applied to the stamping of articles with a non-circular cross-section, the formation and the motion of supporting cores for articles of this type consequently being adapted. A stamping machine according to the invention may also be used with individual cores, which are not integrated into a turntable of the type previously disclosed, and which ensure an appropriate movement of articles which are to be stamped.

Further, the motion transferred to the elements of the stamping machine may also be different from that disclosed and illustrated. In particular, with a flat punch, the punch may be fixed in translation relative to the machine frame during stamping, the article to be stamped then being moved simultaneously in rotation and in translation relative to the punch during stamping. The combination of the suction box and the braking surface is then used to reduce the strain undergone by the stamping foil during the rapid rewinding thereof, in the case of high stamping rates. Further, the movement which brings the stamping member into contact with an article to be stamped may be performed by the stamping member and not by the core which supports the article. In the disclosed embodiments, the stamping member 6 or 206 may thus be intended to move vertically, the vertical movement of the cores 9 or 209 then no longer being necessary.

Moreover, if the flat punch is able to move in translation relative to the machine frame during stamping, as in the first embodiment, the different elements 12-19 for controlling the stamping foil may or may not be moved with the punch, independently of one another or simultaneously. It is thus possible for only the braking surface to be moved with the punch in the first embodiment, whilst the rewinding means 15-17 are fixed relative to the machine frame. Conversely, it is possible for only the rewinding means 15-17 to be moved with the punch, with the braking surface being kept fixed. The unwinding means 12-14 and the suction box 18 may also be moved with the punch while the braking surface itself is moved. The movement of the stamping foil opposite the punch is fitted to each arrangement via appropriate programming of the unwinding and rewinding means of the stamping foil. In particular, the sequence of the movement of the stamping foil during a marking sequence with a flat punch is the same, for an arrangement of the stamping machine in which the unwinding means 12-14 and rewinding means 15-17 of the stamping foil are fixed relative to the machine frame, as that disclosed in the second embodiment which makes use of the stamping wheel 206.

The relative position shown in the first and second embodiments for the stamping foil guidance elements may also be altered, it being possible for the suction box to be disposed horizontally relative to the unwinding means, or even below said unwinding means. The braking surface for the stamping foil, formed by the braking cylinder in the disclosed examples, may also be of any other form which is not a portion of a cylinder, in particular flat. Further, this braking surface may be integrated with the interior of the suction box, being formed for example by a wall of said suction box. An arrangement of this type is more compact and allows the space requirement of the stamping machine to be reduced.

The invention claimed is:

1. Hot stamping machine comprising a stamping member for pressing a stamping foil against a peripheral surface of individual articles in order to stamp the articles, the individual articles being positioned successively into a stamping position and stamped by a stamping sequence which is repeated for each article, the machine including a stamping foil unwinding means that sequentially unwinds a length of stamping foil at the end of each stamping sequence for the next stamping sequence, and stamping foil rewinding means, the stamping machine further including a stamping foil suction box and a stamping foil braking surface, the braking surface being fixed in rotation relative to a frame of the machine during each stamping sequence, the stamping foil which comes from the unwinding means passing in succession into the suction box, along the braking surface and opposite the stamping member, in such a way that a reserve of stamping foil is available in the suction box between the unwinding means and the braking surface, while the stamping foil is tensioned opposite the stamping member between the braking surface and the rewinding means, wherein the stamping member moves in translation relative to the frame of the machine and parallel to an axis during the stamping of an article, the machine including moving means for moving an article relative to the stamping member, which moving means moves an article solely in rotation about an axis during stamping, and wherein the braking surface performs a movement in translation relative to the frame of the machine which is identical to that of the stamping member during the stamping of an article.

2. Stamping machine according to claim 1, wherein the braking surface includes suction holes for providing a suction force on the stamping foil.

3. Stamping machine according to claim 1, wherein the braking surface is formed by a braking cylinder, around which the stamping foil is partially wound.

4. Stamping machine according to claim 3, wherein the braking cylinder includes an external casing, which forms the braking surface, and a hollow internal body, housed in a casing and connected to a negative pressure source, the casing including suction holes in the braking surface for the suction of the stamping foil, which communicate with the interior of the hollow body via corresponding holes in the body, and means to angularly offset the holes in the body being relative to the holes of the casing in such a way as to modify the suction force exerted on the stamping foil by the braking surface.

5. Stamping machine according to claim 1, wherein the unwinding means are motorized, the machine including detection means for detecting the length of the stamping foil which is available between the unwinding means and the braking surface, the detection means being connected to a motorization system of the unwinding means in such a way as to modify the aforementioned length of the stamping foil.

6. Stamping machine according to claim 1, wherein the suction box includes means for confining the stamping foil against internal walls of the suction box.

7. Stamping machine according to claim 1, wherein the rewinding means perform a movement in translation relative to the frame of the machine which is identical to that of the stamping member during the stamping of an article.

8. Stamping machine according to claim 1, wherein the stamping member is a flat punch.

* * * * *